US006286562B1

(12) United States Patent
Zenoni et al.

(10) Patent No.: US 6,286,562 B1
(45) Date of Patent: Sep. 11, 2001

(54) ELECTRO-MAGNETIC LAMINA TYPE WEFT BRAKE

(75) Inventors: Pietro Zenoni; Giovanni Pedrini, both of Leffe; Rosario Castelli, Gandino, all of (IT)

(73) Assignee: L.G.L. Electronics S.p.A., Gandino (IT)

( * ) Notice: Subject to any disclaimer, the term of this patent is extended or adjusted under 35 U.S.C. 154(b) by 0 days.

(21) Appl. No.: 09/668,456

(22) Filed: Sep. 25, 2000

(30) Foreign Application Priority Data

Oct. 26, 1999 (IT) ..... TO99A0927
Feb. 4, 2000 (IT) ..... TO00A0106

(51) Int. Cl.[7] ..... B65H 59/22; B65H 59/20; D03D 47/34

(52) U.S. Cl. ..... 139/370.2; 242/419.3; 139/450; 139/452; 335/257

(58) Field of Search ..... 139/194, 370.2, 139/450, 452; 242/149, 419.4, 419.3, 150 M; 335/257

(56) References Cited

U.S. PATENT DOCUMENTS 4,875,506 * 10/1989 Gacscay et al. ..... 139/450
5,398,731 * 3/1995 Schuster ..... 139/450
5,398,732 * 3/1995 Zenoni et al. ..... 139/450
5,492,286 * 2/1996 Motta ..... 139/450

* cited by examiner

*Primary Examiner*—Andy Falik
(74) *Attorney, Agent, or Firm*—Guido Modiano; Albert Josif; Daniel O'Byrne

(57) ABSTRACT

A weft brake for weaving looms, comprising a rigid, fixed and flat plate made of non-magnetic material and a flexible lamina made of magnetic material, between which a weft thread slides; the flexible lamina is actuated magnetically against the rigid and fixed plate by the action of a plurality of permanent magnets which are supported by a movable yoke; the yoke is subjected to an electric actuator which moves the yoke with respect to the lamina, moving the magnets towards or away from the lamina; due to this action, the attraction applied by the magnets to the lamina varies and accordingly varies the pressure that the lamina applies to the thread.

15 Claims, 5 Drawing Sheets

ELECTRO-MAGNETIC LAMINA TYPE WEFT BRAKE

BACKGROUND OF THE INVENTION

The present invention relates to a weft brake, particularly for weaving looms and the like.

As it is known, weft thread is fed to weaving looms by unwinding the weft thread from a spool which is arranged ahead of a weft thread feeder, from which the thread is then sent to the weaving loom or other textile machine.

Electrically-actuated weft brakes are typically inserted between the spool and the feeder and between the feeder and the loom and are meant to modulate the mechanical tension of the thread in order to adapt it to the weaving requirements.

Modulation of the braking action is achieved in several conventional manners and in particular by passing the thread between two laminar elements, respectively a fixed one and a movable one, and by varying the mechanical pressure with which the movable element is pressed against the cooperating fixed element.

As an alternative, both the fixed element and the movable element are comb-shaped, with tines ending with transverse bars which mutually interpenetrate, varying the degree of mutual penetration of the two combs, which accordingly deflect to a greater or smaller extent the path of the thread, correspondingly braking its sliding.

In both cases, the movable element of the weft brake is moved by an electric actuator which is supplied with a current modulated according to the modulation of the intended braking action.

As it is also known, the movable element of weft brakes is actuated by means of linear electric motors, particularly with three-pole motors having very high intervention speeds and requiring very low excitation currents.

Conventional weft brakes of the specified type, while providing excellent performance in terms of braking action, suffer drawbacks and in particular are not entirely satisfactory as regards the possibility to modulate the braking action.

Moreover, the weft brakes can break the thread rather easily, especially in the presence of uneven portions, e.g. in the presence of knots or weaker portions of the thread.

SUMMARY OF THE INVENTION

The aim of the present invention is to eliminate the above noted drawbacks and to provide a weft brake which not only can apply a powerful and rapid braking action when required but also can apply an action which can be easily modulated and most of all is gradual, in order to facilitate the passage of knots or other uneven portions, where the term "gradual" designates a braking action which is not only modulated but variable from the inlet to the outlet of the weft brake.

Another important object of the invention is to provide a weft brake which has a simplified and sturdy structure and is very reliable in operation.

Another important object of the invention is to provide a weft brake which is capable of containing the moving thread and of preventing the thread from disengaging from the fixed and movable elements and escaping the modulated braking action of the weft brake.

In order to achieve this aim, these and other objects which will become better apparent from the following detailed description, the present invention provides for a weft brake for weaving looms having the specific characteristics stated in the appended claims.

Substantially, the invention is based on the concept of making the weft thread slide between a rigid and flat fixed plate made of non-magnetic material (e.g. aluminum) and a flexible lamina made of magnetic material (e.g. steel) in which only one end is rigidly coupled to the rigid support; and of magnetically actuating the lamina against the fixed and rigid plate by means of a movable yoke provided with a plurality of permanent magnets and subjected to an electric actuator which is energized by a current modulated according to the modulation required for the braking action, and which moves the yoke with respect to the lamina so as to move the magnets towards or away from the lamina in order to correspondingly vary the attraction applied by the magnets to the lamina and accordingly vary the pressure that the lamina applies to the thread to brake it.

BRIEF DESCRIPTION OF THE DRAWINGS

The characteristics, purposes and advantages of the weft brake according to the present invention will become better apparent from the following detailed description and with reference to the accompanying drawings, given by way of non-limitative example, wherein.

DESCRIPTION OF THE PREFERRED EMBODIMENTS

Figure 1:
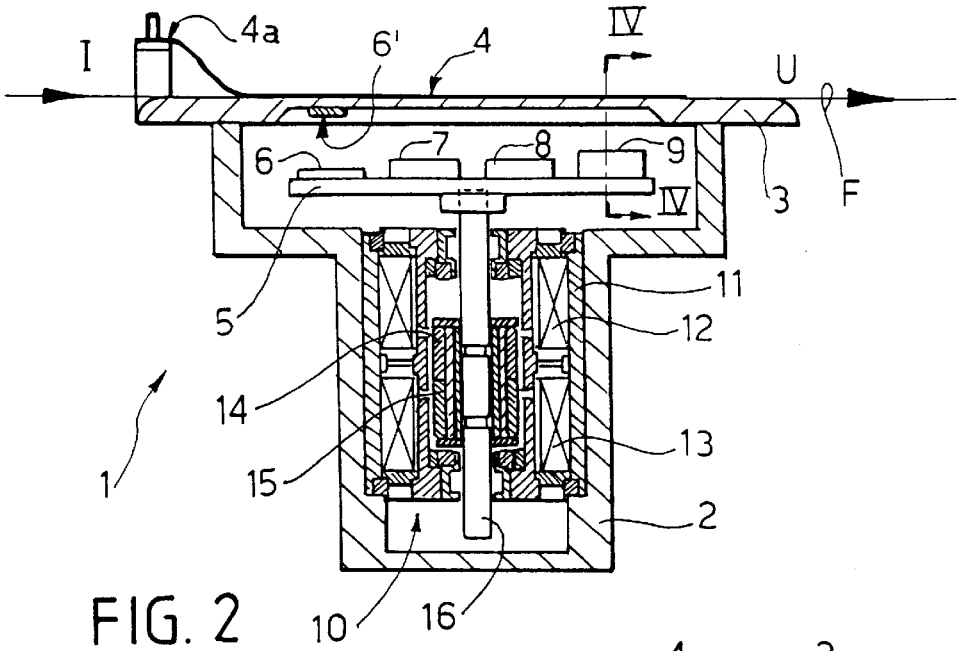
FIG. 1 is an axial sectional view of the weft brake according to a first embodiment of the invention, the device being shown in the inactive or idle configuration.
Figure 2:
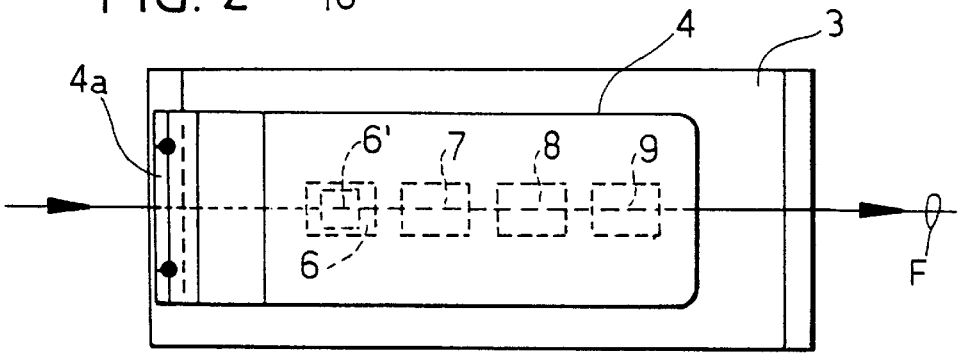
FIG. 2 is a top plan view of FIG. 1.
Figure 3:
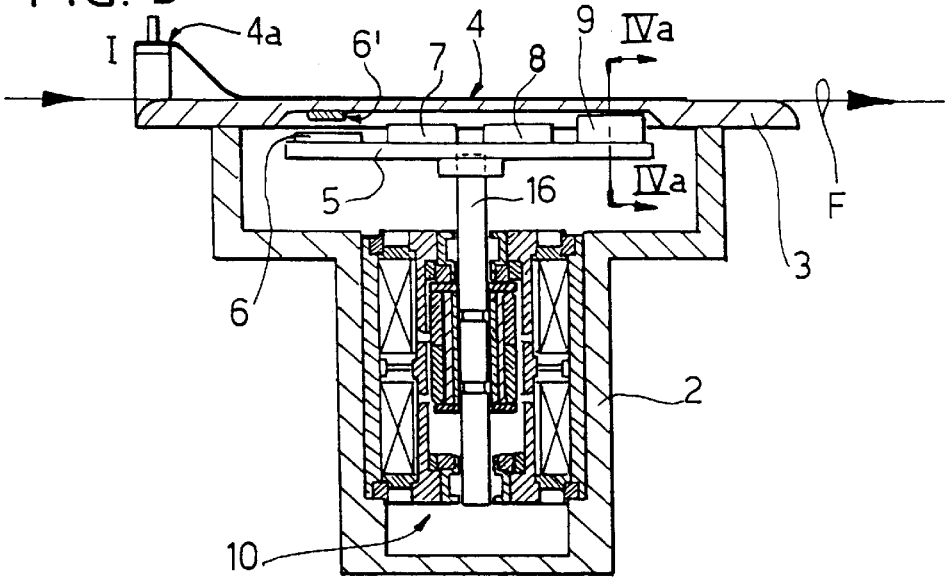
FIG. 3 is a sectional view, similar to FIG. 1, of the device in the active configuration.
Figure 4:
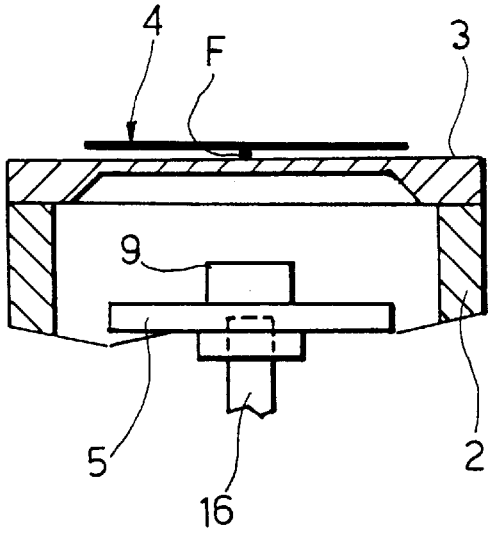
FIG. 4 is a transverse sectional view, taken along the plane IV—IV of FIG. 1.

Initially with reference to FIGS. 1 to 4, 1 generally designates a weft brake, which substantially comprises a hollow body 2 ending with a flat rigid upper plate 3 which is rigidly coupled to the body 2. The plate 3 is made of non-magnetic material, typically aluminum, and supports a flexible lamina 4 made of magnetic material, typically spring steel. The lamina 4 preferably has one end 4*a* which is rigidly coupled to the rigid plate 3 and another end which is free, and the weft thread F to be subjected to the modulated braking action slides between the lamina and the plate. Typically, the coupled end 4*a* of the lamina 4 is located at an inlet I and the free end is located at an outlet U of the weft brake.

In order to produce the modulated braking action, a yoke 5, which can move in a straight line and supports a plurality of permanent magnets 6, 7, 8 and 9, is arranged below the fixed plate 3 so that the flux generated by the magnets, by passing through the fixed plate, concatenates with the lamina 4, to which it applies a strong attraction which presses it against the fixed plate 3.

According to the invention, the yoke 5 is subjected to an electric actuator 10 which is driven by a current modulated according to the modulation required for the braking action; the actuator moves the yoke 5 with respect to the lamina 4, correspondingly varying the attraction applied by the flux of the magnets 6 to 9 to the lamina.

Preferably, the actuator 10 is constituted by a linear electric motor comprising a stator 11, of the type with three poles, two excitation coils 1213 and a rotor, with two cylindrical permanent magnets 14–15 which are supported by a motor shaft 16 connected to the yoke 5, are radially polarized and have opposite polarities.

In a per se known manner, the excitation current of the motor 10 can be supplied by a current amplifier (not shown) and can be modulated according to the mechanical tension acting on the thread F, e.g. by means of a tensiometer (not shown) which directly detects the mechanical tension and emits a modulation signal for driving the amplifier. As an alternative and in an equally conventional manner, the modulation signal can be supplied by a control microprocessor of the loom (not shown), which determines the braking criteria, setting both the intervention times and the intensity of the braking action.

In both cases, the excitation current produces a corresponding smaller or larger movement of the yoke 5 at right angles to the lamina 4, moving it towards or away from the lamina and thus correspondingly varying the braking action produced by the force with which said lamina presses against the plate 3 and on the thread F that rests against the plate 3.

In order to control the movement of the yoke 5 and therefore control the correct braking action applied by the device 1, one magnet of the yoke 5, e.g. the magnet designated by the reference numeral 6, cooperates with a proximity sensor 6', supported by the plate 3 so as to face it, which can emit a signal proportional to the linear movement of the yoke; such signal is used to provide feedback for the motor 10 in order to contain its movements within the intended limits.

Moreover, and as clearly shown in FIG. 1, the thickness of the magnets 7, 8 and 9 can be different in order to render the braking action gradual from the inlet I to the outlet U of the device.

In particular, the magnet designated by the reference numeral 9, which is arranged adjacent to the outlet U of the device, is typically thicker than the others; this thickness allows to apply the most intense attraction at the free end of the lamina 4 (FIG. 3), where the lamina is most flexible.

This entails that the intensity of the braking action is rendered gradual and increases from the inlet I to the outlet U of the weft brake, where the highest flexibility of the lamina 4 easily tolerates without appreciable consequences the passage of any discontinuities of the thread and, in particular, the passage of knots or weak points of the thread.

Figure 4A:
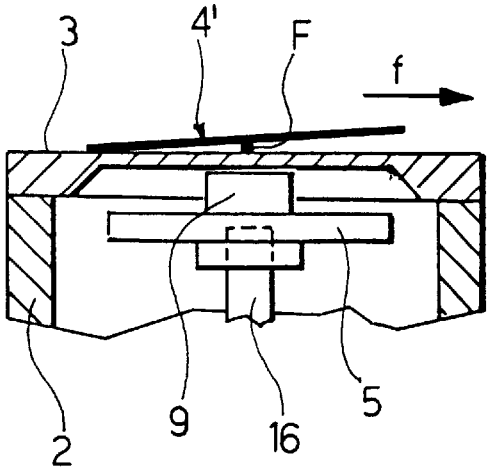
FIG. 4*a* is a sectional view, taken along the plane IVa—IVa of FIG. 3.

In the above described embodiment, the magnets 6 to 9 of the yoke 5 are aligned in a single row (FIGS. 2 and 4) whose central plane coincides with the diametrical plane of the shaft 16; this entails that when the yoke 5 is raised into the active position shown in FIG. 4*a* the lamina 4 is inclined. The lamina in fact pivots about the thread F and arranges itself obliquely with respect to the horizontal inactive position (FIG. 4), and by assuming the position designated by the reference numeral 4' it allows the thread F to escape engagement by the lamina 4 if it is actuated in the direction in which the lamina divaricates, designated by the arrow f of FIG. 4*a*.

Figure 5:
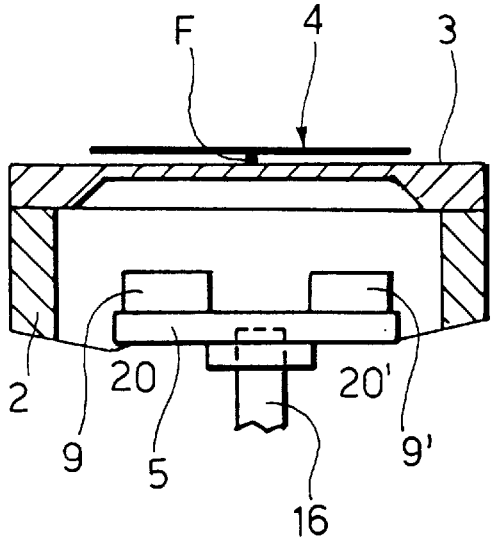
FIGS. 5 and 5*a* are transverse sectional views, similar to FIGS. 4 and 4*a*, of a second embodiment of the invention.
Figure 5A:
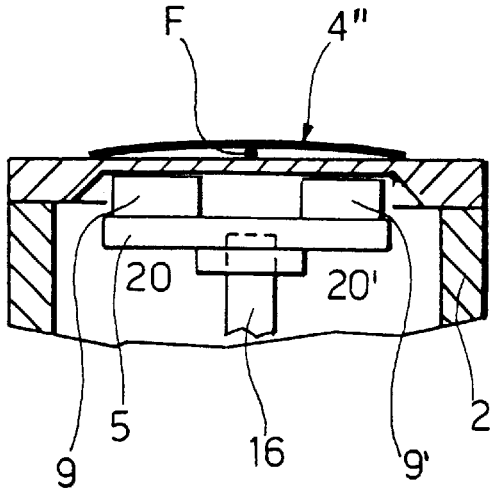
Figure 6:
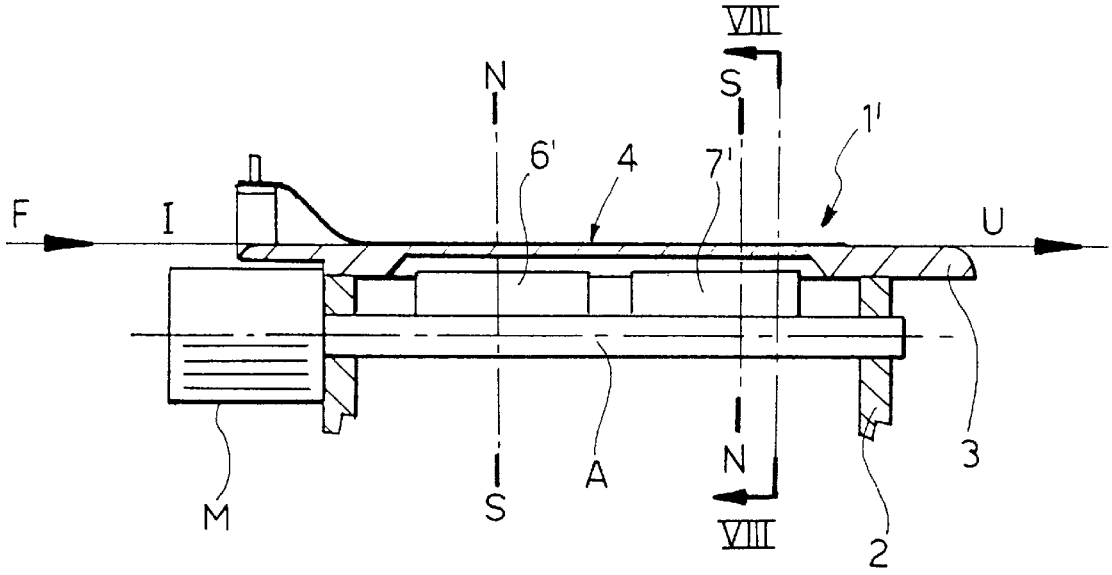
FIG. 6 is a longitudinal sectional view, taken along the multiple lines VI—VI of FIG. 7, of an improved weft brake according to a third embodiment of the invention.
Figure 7:
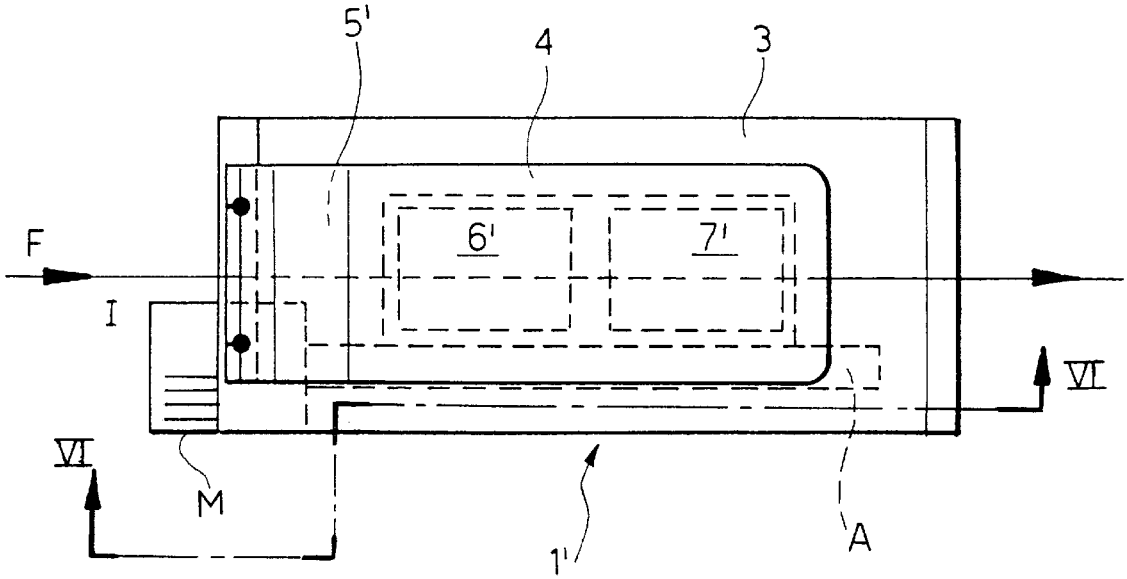
FIG. 7 is a top plan view of the device of FIG. 6.
Figure 8:
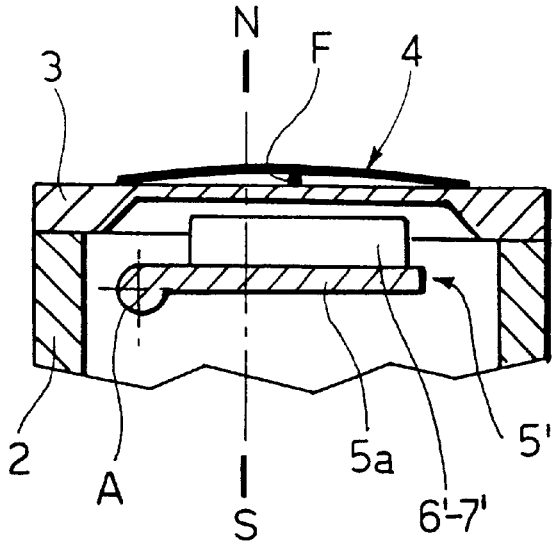
FIG. 8 is an enlarged-scale transverse sectional view, taken along the plane VIII—VIII of FIG. 6, of the device with the magnet supporting yoke in the active position.

In the second embodiment of FIGS. 5 and 5*a*, in order to avoid this drawback, the yoke 5 has two rows 20, 20' of magnets arranged side by side. In this manner, the magnetic field produced by the two rows of magnets, by concatenating with the lamina 4, bends the lamina, which assumes a circular segment-like profile designated by the reference numeral 4" and shown in FIG. 5*a*; the profile 4" being adapted to effectively contain the thread F and to prevent in any case its disengagement from the lamina 4.

In the first embodiment described above with reference to FIGS. 1 to 5, the co-planar arrangement of the flexible lamina 4 and of the permanent magnets supported by the movable yoke 5 causes the lamina to be crossed by a magnetic flux which, despite being reduced, subjects it to a weak attraction force even in the inactive position, i.e. when the magnet supporting yoke and the magnets rigidly coupled thereto are at the maximum distance from the lamina 4.

This can sometimes alter the modulation of the braking action, which by never becoming zero, induces in the weft thread, especially if it is very thin, unwanted mechanical tensions with consequent possible breakage of the thread.

Figure 9:
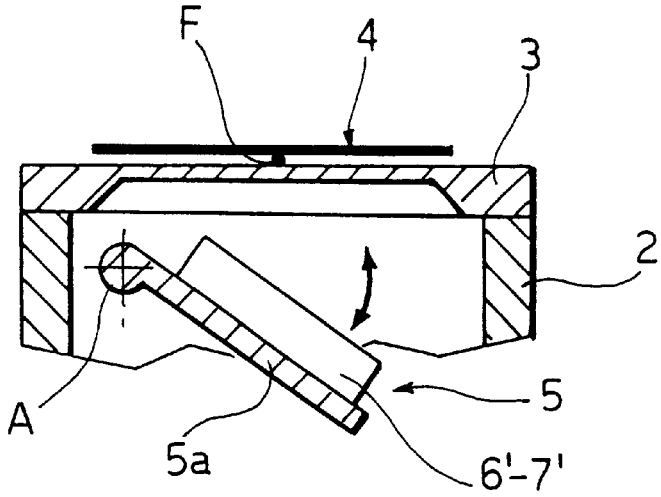
FIG. 9 is a sectional view, similar to FIG. 8, of the device of FIG. 6 with the magnet supporting yoke in the inactive position.

The third and fourth embodiments of FIGS. 6 to 11 are designed to eliminate this drawback. For this purpose, the constructive variation provides a weft brake 1' in which the braking action is applied to the weft thread F by an oscillating yoke 5' (FIGS. 8 and 9) which supports a plurality of permanent magnets, two magnets 6', 7' in the illustrated example, which are arranged side by side and preferably have alternately reversed N-S polarities. As clearly shown in the figures, the yoke 5' is constituted by a flat support 5*a* which has a rectangular profile and can be made of plastic or metal or metal alloys and supports, monolithically and at one of its longer sides, a pivot which is arranged parallel to said longer side and coincides with the shaft A of an electric motor M which is capable of moving by 90° in the two directions of rotation. Accordingly, the oscillating yoke 5' moves angularly with respect to the flexible lamina 4 between two co-planar and perpendicular end positions, shown respectively in FIGS. 8 and 9. In this manner, and in accordance with the stated purpose, the intensity of the magnetic flux that affects and crosses the lamina 4 varies according to the variation of the inclination of the yoke 5' with respect to the lamina, assumes the maximum value for the configuration in which the yoke and the lamina are co-planar (FIG. 8) and becomes zero for the configuration in which the yoke is perpendicular, or substantially perpendicular, to the lamina 4 (FIG. 9). Since the intensity of the magnetic flux affecting the lamina varies from zero to a maximum over an angle of only 90°, small angular movements of the yoke 5' produce significant variations in the attraction force applied by the magnets 6'–7' to the lamina 4 and therefore produce significant variations in the braking action applied by the lamina to the weft thread F. This provides a particularly rapid and prompt response of the weft brake 1' according to the described embodiment.

Figure 10:
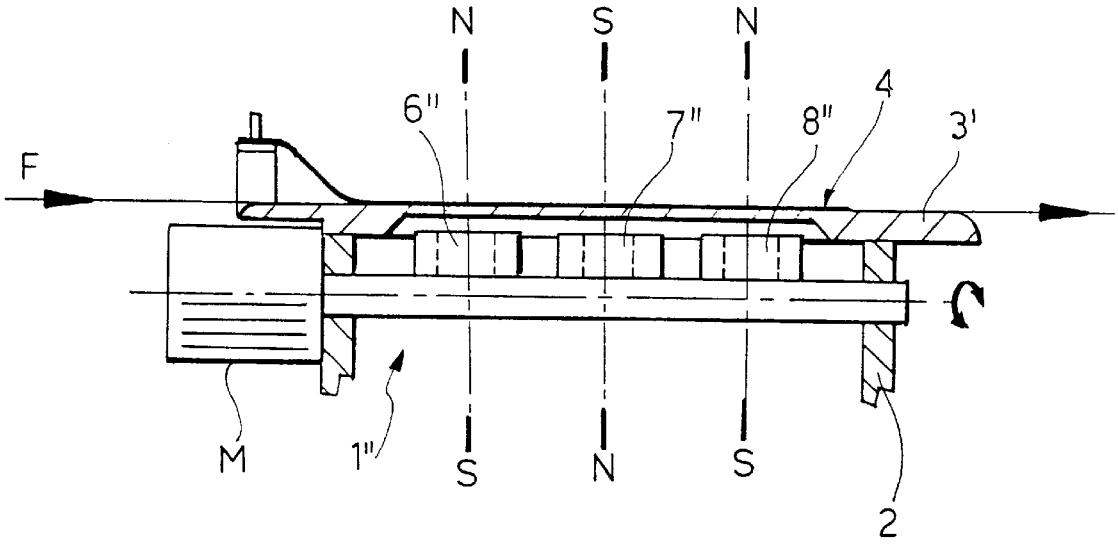
FIG. 10 is a sectional view, similar to FIG. 6, of a fourth embodiment of the invention.
Figure 11:
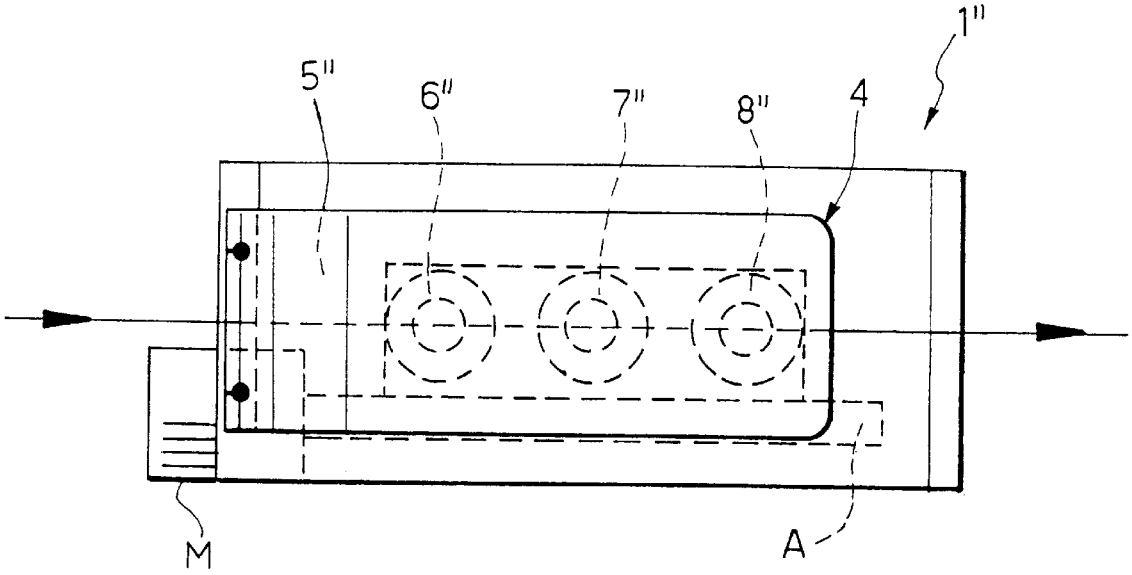
FIG. 11 is a top plan view of the device of FIG. 10.

The fourth embodiment shown in FIGS. 10 and 11 differs from what has been described above only in that the yoke 5" of the corresponding weft brake 1" supports, in order to better distribute the braking action from the inlet I to the outlet U of the device, a set of three permanent magnets 6"–7"–8", which also are arranged side by side and with alternately reversed polarities.

Without altering the principle of the invention, the details of execution and the embodiments may of course be extensively changed further with respect to what has been described and illustrated by way of non-limitative example without thereby abandoning the scope of the invention.

The disclosures in Italian Patent Applications No. T099A000927 and T02000A000106 from which this application claims priority are incorporated herein by reference.

What is claimed is:

1. A weft brake for weaving looms, comprising a rigid, fixed and flat plate made of non-magnetic material and a flexible lamina made of magnetic material, between which a weft thread slides, and wherein said flexible lamina is actuated magnetically against said rigid and fixed plate by the action of a plurality of permanent magnets supported by a movable yoke which is subjected to an electric actuator which moves the yoke with respect to the lamina, moving the magnets towards or away from said lamina in order to correspondingly vary the attraction applied by said magnets to the lamina and accordingly vary the pressure that the lamina applies to the thread.

2. The weft brake according to claim 1, wherein the fixed flat plate is made of aluminum and the flexible lamina is made of steel.

3. The weft brake according to claim 2, wherein said electric actuator is constituted by a linear electric motor which is adapted to move said movable yoke at right angles to said lamina and has a motor shaft rigidly coupled to the movable yoke and excitation coils excited with an excitation current modulated according to a modulation sought for the braking action to be applied to said weft thread.

4. The weft brake according to claim 3, wherein a first end of the flexible lamina is rigidly coupled to the rigid and fixed plate and a second end of the lamina is free.

5. The weft brake according to claim 4, wherein the rigidly coupled end of the lamina is arranged at an inlet and the free end of said lamina is arranged at an outlet of the weft brake.

6. The weft brake according to claim 4, wherein said movable yoke supports at least one row of permanent magnets, and wherein a centerline plane of said row coincides with a diametrical plane of the shaft of said linear motor.

7. The weft brake according to claim 6, wherein said magnets differ in thickness and a thicker magnet of said magnets is arranged on the movable yoke at the free end of the flexible lamina.

8. The weft brake according to claim 7, wherein a magnet of the movable yoke cooperates with a proximity sensor which is supported by the fixed plate and faces said magnet; said sensor being adapted to emit a signal which is proportional to the linear movement of the yoke and is used to provide feedback to the motor that produces the linear movement of said yoke.

9. The weft brake according to claim 1, wherein said movable yoke is provided with two side-by-side rows of permanent magnets and in that a magnetic field generated by said rows of magnets bends said flexible lamina, making said lamina assume a circular segment-shaped profile which is adapted to contain the moving thread and to prevent a disengagement of said thread from said lamina.

10. The weft brake according to claim 1, wherein said supporting yoke performs an angular oscillation and rotates rigidly with a shaft of an electric motor which can move through 90° in both directions of rotation and can produce an angular movement of said supporting yoke, with respect to the flexible lamina, between two co-planar and perpendicular, or substantially perpendicular, end positions with respect to said lamina.

11. The device according to claim 10, wherein said supporting yoke is constituted by a flat support made of plastic, said support having a rectangular profile and a pivot which is formed monolithically thereon and coincides with the shaft of said electric motor.

12. The device according to claim 11, wherein the pivot of said supporting yoke is parallel to one of longer sides of the support that constitutes said yoke.

13. The device according to claim 10, wherein said permanent magnets are arranged side by side on said oscillating yoke and have alternately reversed polarities.

14. The device according to claim 10, wherein said supporting yoke is constituted by a flat support made of metal, said support having a rectangular profile and a pivot which is formed monolithically thereon and coincides with the shaft of said electric motor.

15. The device according to claim 10, wherein said supporting yoke is constituted by a flat support made of metallic alloys, said support having a rectangular profile and a pivot which is formed monolithically thereon and coincides with the shaft of said electric motor.

* * * * *